US008453417B2

(12) United States Patent
Oshio et al.

(10) Patent No.: US 8,453,417 B2
(45) Date of Patent: Jun. 4, 2013

(54) ENVELOPE FILLING APPARATUS

(75) Inventors: Susumu Oshio, Tokyo (JP); Kenichi Shibuya, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 369 days.

(21) Appl. No.: 12/923,233

(22) Filed: Sep. 10, 2010

(65) Prior Publication Data

US 2011/0154778 A1 Jun. 30, 2011

(30) Foreign Application Priority Data

Dec. 25, 2009 (JP) ..... 2009-294657

(51) Int. Cl.

| | |
|---|---|
| ***B43M 3/00*** | (2006.01) |
| ***B43M 3/04*** | (2006.01) |
| ***B65B 57/02*** | (2006.01) |
| ***B65B 63/04*** | (2006.01) |

(52) U.S. Cl.

USPC ..... 53/53; 53/505; 53/67; 53/118; 53/569; 53/381.5; 53/385.1

(58) Field of Classification Search

CPC ..... B43M 3/04; B43M 3/045
USPC ..... 53/53, 55, 505, 64, 67, 569, 284.3, 53/381.5, 381.7, 382.1, 382.2, 385.1, 116–118
IPC ..... B43M 3/00, 7/00
See application file for complete search history.

(56) References Cited

U.S. PATENT DOCUMENTS

| | | | | |
|---|---|---|---|---|
| 3,253,384 | A * | 5/1966 | Huck et al. | 53/53 |
| 3,538,671 | A * | 11/1970 | Wallace | 53/505 |
| 3,583,124 | A * | 6/1971 | Morrison | 53/67 |
| 4,962,623 | A * | 10/1990 | Francisco | 53/284.3 |
| 5,125,214 | A * | 6/1992 | Orsinger et al. | 53/284.3 |
| 5,415,068 | A * | 5/1995 | Marzullo | 53/284.3 |
| 5,722,221 | A * | 3/1998 | Maltman et al. | 53/569 |
| 5,729,954 | A * | 3/1998 | Lines et al. | 53/381.5 |
| 5,950,399 | A * | 9/1999 | Viens et al. | 53/284.3 |
| 6,773,388 | B2 * | 8/2004 | Rathbun | 493/434 |
| 7,427,059 | B2 * | 9/2008 | Lyga et al. | 53/569 |

FOREIGN PATENT DOCUMENTS

| | | |
|---|---|---|
| JP | H05-092841 A | 4/1993 |
| JP | H06-060244 A | 3/1994 |

* cited by examiner

*Primary Examiner* — Stephen F Gerrity
(74) *Attorney, Agent, or Firm* — Manabu Kanesaka

(57) ABSTRACT

An envelope filling apparatus inserts a sheet of paper into an envelope having a flap, and includes an envelope feed device, an air nozzle for blowing air into the envelope fed by the envelope feed device from an open end of the envelope to open the open end, and a sensing device for detecting that the open end of the envelope is opened. The apparatus further includes an insertion device for inserting the sheet of paper into the envelope from the open end, if the sensing device detects that the open end of the envelope is opened after the air nozzle is actuated, and a removal device for removing the envelope from a transport route, if the sensing device does not detect that the open end of the envelope is opened after the air nozzle is actuated and the insertion device is not actuated.

13 Claims, 7 Drawing Sheets

ENVELOPE FILLING APPARATUS

RELATED APPLICATIONS

The present application is based on, and claims priority from Japanese Application No. 2009-294657, filed Dec. 25, 2009, the disclosure of which is hereby incorporated by reference herein in its entirety.

1. Field of the Invention

The present invention relates to an envelope filling apparatus which is, for example, installed adjacent to an image forming apparatus or the like for inserting a printed sheet of paper discharge from the image forming apparatus or the like into an envelope fed to a prescribed position. Particularly, the invention relates to an envelope filling apparatus capable of properly determining whether the front and back as well as the forward and backward ends of an envelope in the feed position are placed in a state fit for sheet insertion without introduction of a complicated and expensive facility.

2. Description of Related Art

For example, business enterprises and other organizations may deliver to users and the like by mail print pieces and the like in envelopes containing necessary information according to various purposes such as notice and contact statement, advertising statement, billing statement, and others to users, organization members, etc. To do this, it is necessary to insert the print pieces and the like into envelopes. This workload becomes very large depending on the number of users to receive them and the number of types of documents to send out. Therefore, it is desirable to perform envelope filling work for folding and inserting a document into an envelope efficiently by using an automated machine.

JP-A No. Hei 5-92841 discloses an envelope feed controller for types of envelopes which senses incorrect positioning of an envelope in regard to the front and back as well as the forward and backward ends of the envelope and prevents erroneous printing. Some means for sensing the front and back as well as the forward and backward ends of an envelope are disclosed, including mechanical sensing means based on a weight difference between one side of an envelope with flaps and the other side without flaps and the use of a device for sensing the thicknesses of the parts of an envelope with a transmission sensor, a distance sensor using laser, or the like.

JP-A No. Hei 6-60244 discloses a mechanism for depositing money in an envelope for an automatic teller machine. This mechanism is intended to reduce faults in a transport path and to improve user operability and prevent erroneous operation. Following a shutter, an image sensor is installed to read letters and graphics on the surface of an envelope. The thus read letters and graphics are compared to standard envelope data and subjected to screening. The front and back of an envelope and its forward and backward ends are distinguished, the position of a print head is corrected by a position shifting mechanism, and control is performed for printing in a correct position on the envelope surface.

According to the invention described in JP-A No. Hei 5-92841, the mechanical sensing means for detecting the front and back of an envelope based on a weight difference between one side of an envelope with flaps and the other side without flaps is incapable of sensing With accuracy due to individual difference of envelopes. All the sensing means including this mechanical sensing means in the invention described in JP-A No. Hei 5-92841 are complicated and expensive, thus resulting in rather a high price of the apparatus as a whole. Like the sensing means in the invention described in JP-A No. Hei 5-92841, in the way of sensing that directly senses the presence of flaps, the front and back of an envelope can be perceived, but the forward and backward ends of an envelope cannot be determined correctly.

According to the invention described in the above-mentioned JP-A No. Hei 6-60244, since letters and graphics printed or transcribed on the surface of an envelope are necessary, printing on envelopes needs to be performed, consuming man-hours. Further, there is a possibility of printing on a wrong side.

With the foregoing problems in view, an object of the present invention is to provide an envelope filling apparatus capable of correctly sensing and determining whether the front and back as well as the forward and backward ends of an envelope into which a sheet of paper is to be inserted are placed properly for sheet insertion without requiring complicated and expensive means and cumbersome man-hours.

SUMMARY OF THE INVENTION

According to a first aspect of the invention, an envelope filling apparatus for inserting a sheet of paper into an envelope with its open end having a flap is provided, the apparatus including:

envelope feed means for feeding an envelope oriented in a fixed orientation to a prescribed position;

an air nozzle for blowing air into an envelope fed by the envelope feed means from the open end of the envelope to open the open end; and sensing means installed above an envelope fed by the envelope feed means for detecting that the open end of the envelope has been opened.

A second aspect of the invention resides in the envelope filling apparatus according to the first aspect, wherein the air nozzle is configured to blow air toward a position corresponding to a flap of an envelope placed in the prescribed position by the envelope feed means.

A third aspect of the invention resides in the envelope filling apparatus according to the first aspect, further including retaining means for retaining a flap of an envelope placed in the prescribed position by the envelope feed means.

A fourth aspect of the invention resides in the envelope filling apparatus according to the second or third aspect, further including:

insertion means for inserting a sheet of paper into an envelope from an open end, if the sensing means has detected that the open end of the envelope has been opened after the air nozzle is actuated; and removal means for removing an envelope from a transport route, if the sensing means does not detect that the open end of the envelope has been opened after the air nozzle is actuated and the insertion means is not actuated.

A fifth aspect of the invention resides in the envelope filling apparatus according to the forth aspect, further including:

two pairs of envelope rolling rollers disposed in two (fore and rear) positions just before and after spacing which is shorter than a length of an envelope in a stage following the position of the envelope fed by the envelope feed means, wherein the envelope rolling rollers convey an envelope containing a sheet of paper inserted therein to a prescribed position for discharge and guide an envelope containing no sheet of paper to a prescribed position for discharge;

wherein the removal means includes a separator having a fulcrum point in the center of an envelope transport path between the two pairs of envelope rolling rollers and a mechanism adapted such that, after an envelope containing no sheet of paper is conveyed by the envelope rolling rollers until the longitudinal center of the envelope comes to the fulcrum point of the separator, the envelope rolling rollers in each of the two pairs are separated from each other to release the nipping of the envelope, and the envelope is let fall in an underneath position for removal by rotating around the fulcrum point by its own weight.

A sixth aspect of the invention resides in the envelope filling apparatus according to the fifth aspect, wherein the removal means rotates the envelope rolling rollers in the rear position reversely to normal rotation for conveying an envelope downstream, when letting the envelope fall in the position for removal by rotating around the fulcrum point by its own weight.

According to the envelope filling apparatus of the first aspect, when the envelope feed means feeds an envelope oriented in a fixed orientation to a prescribed position, the air nozzle blows air into the envelope from its open end and the air expands the envelope, thereby opening the open end. When the sensing means installed above an envelope detects that the open end of the envelope has been opened, the operation of inserting a sheet of paper into the envelope can be performed using the result of the detection, so that the sheet of paper can be inserted into the envelope properly. If the sensing means installed above an envelope does not detect that the open end of the envelope has been opened after the air nozzle is actuated, this means that the open end of the envelope is not placed with the flap down in the position toward which air is blown by the air nozzle and air from the air nozzle has not entered the envelope. It is thus detected and determined that the front and back as well as the forward and rearward ends of the envelope are not placed in a state not fit for sheet insertion. Accordingly, using such result of the detection by the sensing means, the operation of removing the envelope from the process or a similar operation can be performed without performing the operation of inserting a sheet of paper into the envelope.

According to the envelope filling apparatus of the second aspect, in the effect achieved by the envelope filling apparatus of the first aspect, because air from the air nozzle is blown toward a position corresponding to the flap of the envelope place in the prescribed position by the envelope feed means, if the front and back as well as the forward and rearward ends of the envelope are placed properly for sheet insertion, the air hitting against the inner face of the flap presses the flap and fixates the position of the envelope and the air hitting against the flap enters the envelope and expands the envelope. If the front and back as well as the forward and rearward ends of the envelope are placed improperly for sheet insertion, the air from the air nozzle does not enter the envelope.

According to the envelope filling apparatus of the third aspect, in the effect achieved by the envelope filling apparatus of the first aspect, because the retaining means retains the flap of the envelope placed in the prescribed position by the envelope feed means before the air nozzle performs air injection, the envelope can be expanded by injecting air so that the air will enter the open end instead of directing the air injected from the air nozzle directly toward the inner face of the flap and it is avoided that the envelope is displaced by the farce of the air.

According to the envelope filling apparatus of the fourth aspect, in the effect achieved by the envelope filling apparatus of the second or third aspect, if the sensing means has detected that the open end of the envelope has been opened after the air nozzle is actuated, the insertion means is actuated to insert a sheet of paper into the envelope from the open end. If the sensing means does not detect that the open end of the envelope has been opened after the air nozzle is actuated and the insertion means is not actuated, the removal means is activated to remove the envelope from the transport route.

According to the envelope filling apparatus of the fifth aspect, in the effect achieved by the envelope filling apparatus of the fourth aspect, if the front and back as well as the forward and rearward ends of an envelope are placed properly and a sheet of paper has been inserted into the envelope, the envelope rolling rollers convey the envelope to the prescribed position for discharge. If the front and back as well as the forward and rearward ends of an envelope are placed improperly and no sheet of paper has been inserted into the envelope, after the envelope rolling rollers convey the envelope containing no sheet of paper until the longitudinal center of the envelope comes to the fulcrum point of the separator, the envelope rolling rollers in each of the two pairs are separated from each other to release the nipping of the envelope. The envelope falls in the underneath position for removal by rotating around the fulcrum point by its own weight. At this time, the envelope drops with the open end and flap up and the closed bottom end down. Thus, disadvantage such as damaging the flap when the envelope drops is avoided and the envelope removed as an empty one can be returned to the envelope feed means and used again for sheet insertion.

According to the envelope filling apparatus of the sixth aspect, in the effect achieved by the envelope filling apparatus of the fifth aspect, by rotating the envelope rolling rollers in the rear position reversely to normal rotation for conveying an envelope downstream, the rotation of the envelope around the fulcrum point by its own weight is intensified. This can further ensure that the envelope falls in the position for removal with the heavier bottom end down and the lighter open end and flap up.

DETAILED DESCRIPTION OF THE PREFERRED EMBODIMENT

An envelope filling apparatus 1 pertaining to an embodiment relates to an envelope filling apparatus which is installed adjacent to a paper collection tray or the like of an image forming apparatus or the like. If an envelope fed to a prescribed position is placed in a fixed orientation (in regard to its front and back and forward and rearward ends) fit for sheet insertion, the apparatus can insert a printed sheet of paper discharged from the image forming apparatus or the like into the envelope by insertion means and convey it to a prescribed position. If the orientation of the envelope is not proper, the apparatus can remove the envelope from the line without inserting a sheet of paper into the envelope.

Figure 1:
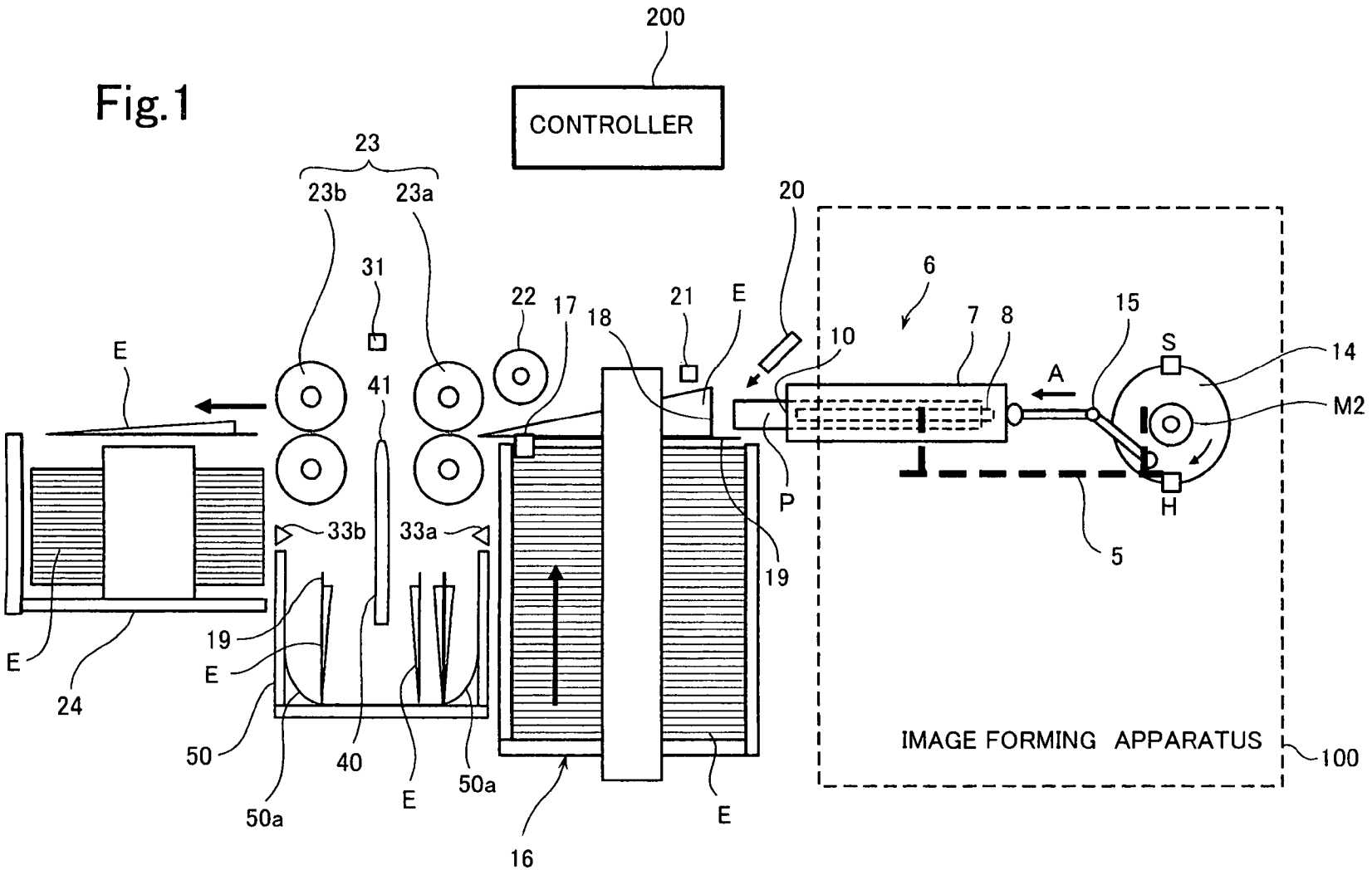
FIG. 1 is an overall structural diagram of an envelope filling apparatus of a first embodiment.

The image forming apparatus 100 shown in FIG. 1 is comprised of an image forming unit, not shown, which forms an image such as letters and graphics on a sheet of paper with a prescribed size and a paper collection tray 5 in which sheets of paper having an image formed thereon discharged from the image forming unit are stacked. In FIG. 1, a sheet of paper having an image formed thereon is discharged from the image forming unit of the image forming apparatus 100 assumed to be present in front in the view of FIG. 1 along a vertical direction in the view toward the paper collection tray 5 present in the back in the view.

As is shown in FIG. 1, downstream of the paper collection tray 5 with respect to a direction of sheet discharge, that is, further in the back of the paper collection tray 5, insertion means 6 is provided adjacent to the tray. The insertion means 6 rolls a sheet of paper P around an axis line which is parallel to the view and horizontal, moves the sheet of paper P parallel to the axis line in a transverse direction (indicated by arrow A) in the view, and inserts the sheet into an envelope E.

Figure 2:
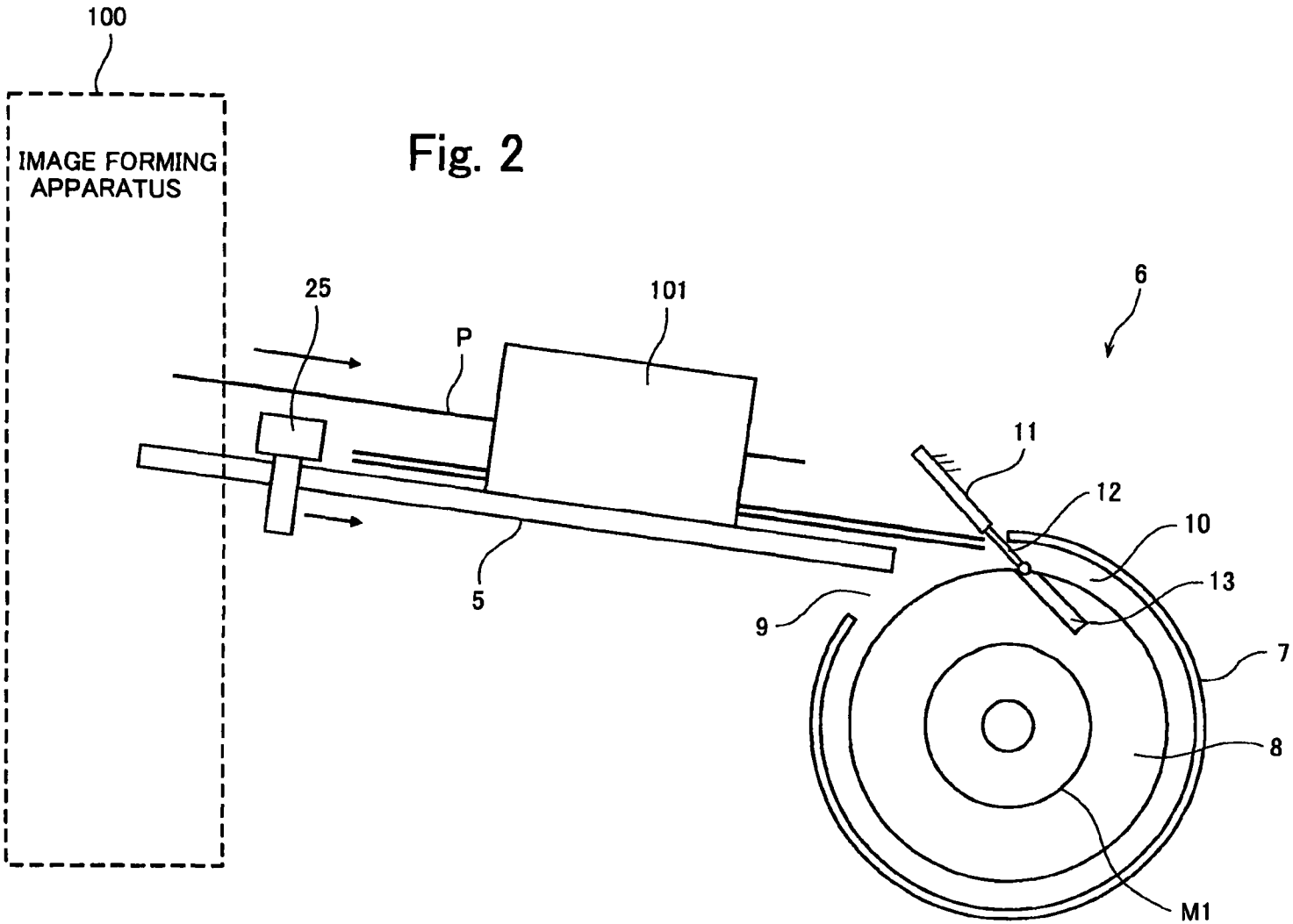
FIG. 2 is a structural diagram of sheet insertion means and its periphery in the envelope filling apparatus of the first embodiment, when viewed from the right side in FIG. 1.

As is shown in FIG. 2 and FIG. 3, the insertion means 6 is comprised of a cylindrical cover 7 for keeping a sheet of paper P rolled and a roll-up roller 8 disposed coaxially with and inside the cover 7 for rolling up a sheet of paper P inside the cover 7.

As is shown in FIG. 2 and FIG. 3, in the peripheral surface of the outer cover 7 of the insertion means 6, a slit-like opening 9 is formed parallel to the axis line, which allows a sheet of paper P being fed to enter the insertion means. Of both end faces of the cover 7, one end face facing the open end 18 of an envelope includes an open discharge outlet 10 from which a part of a sheet of paper P rolled and carried inside the cover 7 protrudes. The central axis of the cover 7 coincides With the axis line of the roll-up roller 8 which turns to roll up a sheet of paper P.

As is shown in FIG. 2, the opening 9 of the cover 7 is in a position relative to the leading end of the sloped paper collection tray 5 of the image forming apparatus 100. Above the opening 9 of the cover 7, an end fence 11 being at an acute angle to the feed direction of a sheet of paper P is installed, fixed to the apparatus frame which is not shown. This end fence 11 serves to guide a sheet of paper P being fed across the paper collection tray 5 to the opening 9 of the cover 7.

As is shown in FIG. 2 and FIG. 3, the peripheral surface of the inner roll-up roller 8 of the insertion means 6 is provided with a clamp plate 12 as means for holding back the leading edge of a sheet of paper P which is going to be fed from the opening 9 of the cover 7. The clamp plate 12 is installed in a slit-like groove 13 formed in the roll-up roller 8. This groove 13 is formed such that it is parallel to the axis line at the peripheral surface and oriented intersecting with the radial direction of the roll-up roller 8 in its depth direction. The clamp plate 12 can be projected from and retracted into the slit-like groove 13, as appropriate, by drive means such as a solenoid which is not shown, and thus can hold back the leading edge of a sheet of paper P onto the peripheral surface of the roll-up roller 8 and release it, when appropriate.

As is shown in FIG. 2, as turning means, a rotary motor M1 is installed on the axis line of the roll-up roller 8, so that the roll-up roller 8 is configured to be allowed to turn in a prescribed roll-up direction when the cover 7 and the roll-up roller 8 are set in a position to receive a sheet of paper P. Therefore, by setting the cover 7 and the roll-up roller 8 in a prescribed position to receive a sheet of paper P, retaining the leading edge of a sheet of paper P being fed by the clamp plate 12, and turning the roll-up roller 8 around the axis line by the rotary motor M1, the sheet of paper P is pulled in the cover 7 and can be wrapped around the peripheral surface of the roll-up roller 8.

As is shown in FIG. 1, the cover 7 is equipped with motion means for causing a reciprocal motion of the cover 7 and the roll-up roller 8 along the axis line. The motion means is comprised of an insert motor M2, a crank plate 14 placed on the rotary shaft of the insert motor M2 and rotating in a clockwise direction in the view of FIG. 1, and an interlocking member 15 which connects the crank plate 14 to the other end of the cover 7. The cover 7 in which the roll-up roller 8 is installed is guided so that it can reciprocate in the axis line direction by guide means not shown. Thus, by driving the insert motor M2 and rotating the crank plate 14, the rotation of the crank plate 14 is transmitted to the cover 7 by the interlocking member 15, and the cover 7 and the roll-up roller 8 can make a direct motion reciprocating in a horizontal direction in the view of FIG. 1.

Also, as is shown in FIG. 1, the crank plate 14 is provided with an insert motor H-point switch (marked H in FIG. 1) and an insert motor S-point switch (marked S in FIG. 1) in two 180-degree opposite positions in the rotational direction, as means for sensing the position of the cover 7 driven by the insert motor M2. The insert motor H-point switch is turned ON when the guide cover 7 is in a home position farthest from an envelope. E, whereas the insert motor S-point switch is turned ON when the guide cover 7 is in a set position where it has been inserted deepest into an envelope.

Figure 3B:
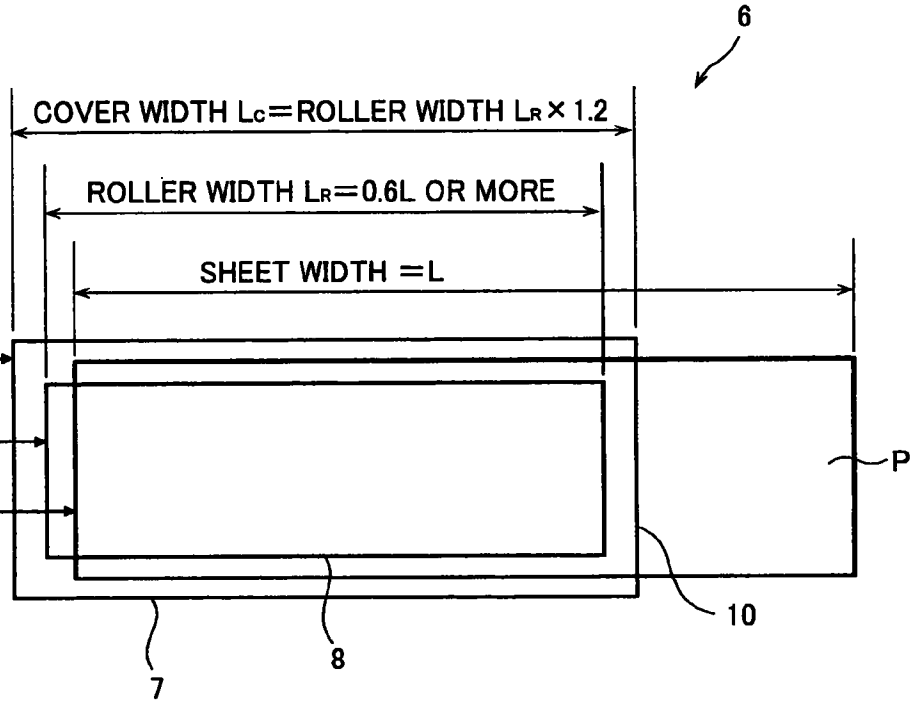
FIG. 3B is a perspective view of the sheet insertion means, when viewed from a perspective perpendicular to the axis line.
Figure 3A:
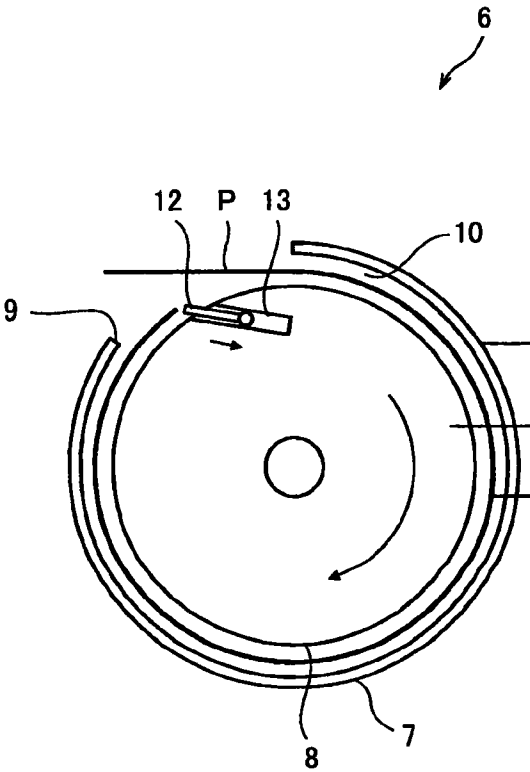
FIG. 3A is a cross sectional view of the sheet insertion means holding a rolled sheet, when viewed from a perspective parallel to an axis line, in the envelope filling apparatus of the first embodiment.

A relationship in dimensions among the cover 7 and the roll-up roller 8 in the insertion means 6 and a sheet of paper P is defined as is shown in FIG. 3. That is, if the dimension of a sheet of paper P in a direction perpendicular to the feed direction of a sheet of paper P is assumed to be the width (sheet width) L of a sheet of paper P, a roller width $L_R$, which is the dimension of the roll-up roller 8 along the axis line direction, should be 0.6 L or more and a cover width $L_C$, which is the dimension of the cover 7 along the axis line direction, should be 1.2 $L_R$=0.72 L, where a relationship among the dimensions is $L>L_C>L_R$. As is shown in FIGS. 3A and 3B, hence, the roll-up roller 8 is completely accommodated in the cover 7 without projecting outside the cover 7 and, when a rolled sheet of paper P is held between the cover 7 and the roll-up roller 8, a part of the rolled sheet of paper P will protrude from the discharge outlet 10 of the cover 7.

As is shown in FIG. 1, with respect to the transport direction, envelope feed means 16 is provided downstream of and adjacent to the insertion means 6. The envelope feed means 16 feeds an envelope by serially moving up a stack of multiple sheets of envelopes E with moving up/down means like an elevator. Each time an envelope E at the top of the stack is used, the moving up/down means moves up a bundle of envelopes E by a necessary distance so that an envelope at the top is always set in the insertion position. It is detected by envelope sensing means 17 that an envelope E at the top has been positioned in the insertion position. Envelopes E stacked in the envelope feed means 16 are oriented so that their open ends 18 are oriented upstream and face the discharge outlet 10 of the cover 7 of the insertion means 6 and their flaps 19 are present on the downside with the open ends 18 being visible from above.

That is, it is assumed that envelopes E are stacked and set in the envelope feed means 16 in a fixed orientation (in regard to their front and back as well as forward and rearward ends), as stated above, which is considered as a normal state.

As is shown in FIG. 1, above the top envelope E among the envelopes E stacked in the envelope feed means 16, an air nozzle 20 is installed as month opening means to open the open end 18 of the envelope E. The air nozzle 20 is means for blowing air into an envelope E to open the open end 18 of the envelope E at the top. After the open end 18 of the envelope E is opened by air from the air nozzle 20, by moving the insertion means 6 holding a rolled sheet of paper P inside it in the axis line direction (indicated by arrow A), the sheet of paper P protruding from the discharge outlet 10 of the cover 7 of the insertion means 6 and a part of the discharge outlet 10 side of the cover 7 of the insertion means 6 are inserted into the envelope E from the open end 18.

According to the embodiment shown in FIG. 1, the air nozzle 20 is configured to blow air toward the upper surface of the flap 19 extending upstream the open end 18 of the envelope E placed in the prescribed position. Thus, if the envelope feed means 16 positions an envelope E in the normal orientation as stated above and the envelope is properly oriented with the flap 19 on the downside extending upstream (toward the insertion means 6) in the longitudinal direction, air from the air nozzle 20 hits against the inner face of the flap 19 (the upper surface of the flap of the top envelope positioned properly) and fixates the envelope E, and then enters the envelope E from the open end 18. Therefore, even if the envelope E is not retained by special means, the envelope E is not moved by the air. The envelope E expands as the air enters the envelope E and becomes ready for insertion of a sheet of paper P into it by the insertion means 6.

Figure 4:
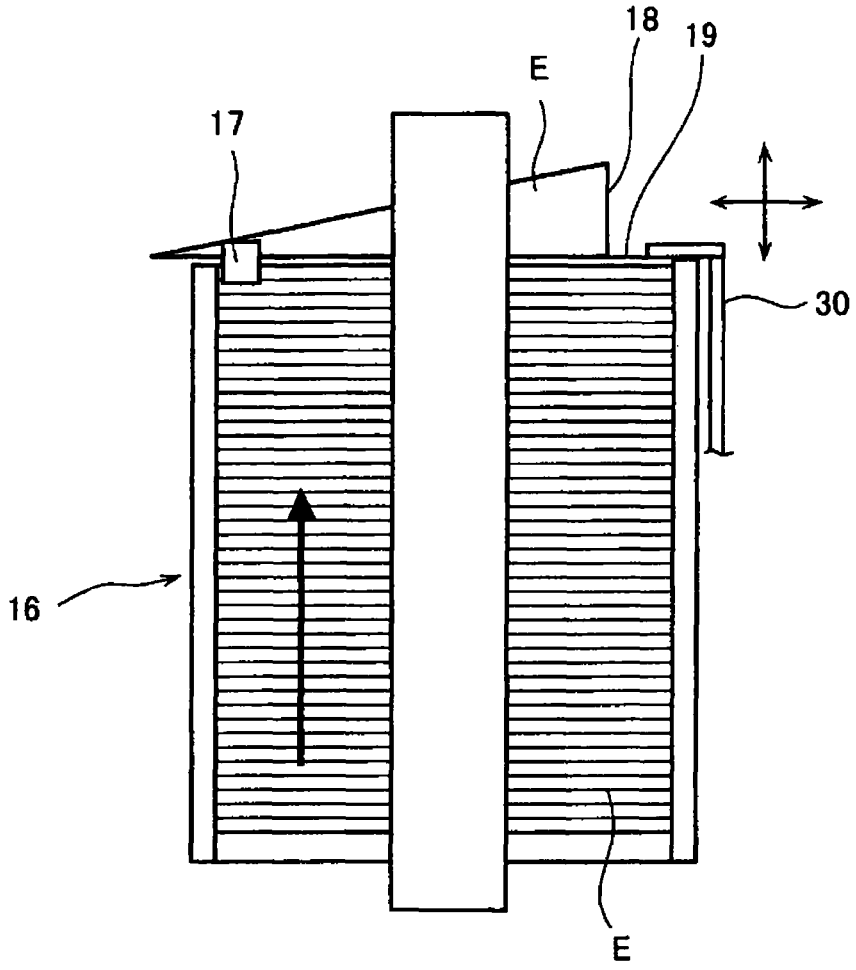
FIG. 4 an enlarged view of envelope feed means and a retaining means in the envelope filling apparatus of the first embodiment.

However, as is shown in FIG. 4 as a modification example, retaining means 30 for envelopes E which can move up and down and move back and forth in the directions of arrows shown in FIG. 4 may be installed adjacent to the upstream side of the envelope feed means 16, thereby keeping the envelope E in the prescribed position of envelope feed means 16 and retaining it in place when the air nozzle 20 is actuated. In this case, the air nozzle 20 does not need to blow air toward the upper surface of the flap 19 extending upstream the open end 18 of the envelope E and can be configured to blow air from a more upstream point and the degree of freedom of arranging components of the apparatus increases. Because envelopes E are retained, there is no possibility of moving the envelope E even by fairly strong air injection of the air nozzle 20. Thus, increased air injection power or injection time of the air nozzle 20 may be used to further ensure that the envelope E expands by the air.

As is shown in FIG. 1, correct envelope position sensing means 21 is installed above and in the upstream side of the envelope feed means 16. The correct envelope position sensing means 21 is adapted to sense the vicinity of the open end 18 of the top envelope E placed in the sheet insertion position in the envelope feed means 16. When the air nozzle 20 is actuated and air enters the envelope E from the open end 18, the envelope E expands by the air, as shown in FIG. 1, and the open end 18 side is raised and becomes closer to the correct envelope position sensing means 21. The correct envelope position sensing means 21 detects a change in the distance to the open end 18 and can detect that the open end 18 of the envelope E has opened and become a state fit for sheet insertion by the insertion means 6.

As is shown in FIG. 1, a pickup roller 22 is installed above and in the downstream side of the envelope feed means 16. The pickup roller 22 can move up and down, as appropriate, by drive means not shown, and is rotatable by drive means not shown. After a sheet of paper P is inserted into the top envelope E in the envelope feed means 16, the pickup roller 22 comes in contact with the upper surface of the envelope E in the downstream side, while rotating, so that it can make the envelope E travel downstream.

As is shown in FIG. 1, envelope rolling rollers 23 which nip the envelope E in which a rolled sheet of paper P has been inserted and convey the envelope downstream are installed downstream of the envelope feed means 16. The envelope rolling rollers 23 nip and press the rolled sheet of paper P contained in the envelope E along with the envelope E, while rolling the envelope E. As a result, the rollers discharge the envelope containing the sheet of paper P folded to a size up to the inner dimensions of the envelope. The envelope rolling rollers 23 are two pairs of upper and lower rollers disposed along the transport direction. Upstream ones are referred to as first envelope rolling rollers 23*a* and downstream ones are referred to as second envelope rolling rollers 23*b*. The length in the axial direction of each envelope rolling roller 23 is larger than the width of an envelope E. Spacing between the first envelope rolling rollers 23*a* and the second envelope rolling rollers 23*b* in the transport direction is shorter than the length of an envelope E.

As is shown in FIG. 1, a filled envelope tray 24 is installed downstream of the envelope rolling rollers 23 and an envelope E (filled envelope E) into which a sheet of paper is inserted, after being rolled, is discharged to this tray.

In the present embodiment, if the top envelope E in the envelope feed means 16 is normally oriented with the flap 19 being on the downside and the open end 18 facing toward the insertion means 6, the air nozzle 20 opens the open end 18 and the insertion means 6 can insert a sheet of paper into the envelope. In that case, the above envelope rolling rollers 23 convey the envelope E and discharge it to the filled envelope tray 24. Otherwise, after the air nozzle 20 is actuated, if the correct envelope position sensing means 21 does not detect that the open end 18 of the envelope E has opened and the insertion means 6 is not actuated, the orientation of the envelope E is regarded as incorrect. Consequently, removal means is configured to separate this empty envelope E from the transport route and remove it to a prescribed position.

The removal means is comprised of a separator 40 having a fulcrum point 41 in the center of the envelope transport path between the above two pairs of envelope rolling rollers 23*a*, 23*b* which operate in a different way than normal conveyance operation as will be described later. Further, an envelope travel distance sensing means 31 which detects the travel distance of an envelope E is disposed between the above two pairs of envelope rolling rollers 23*a*, 23*b*. A box-type container 50 for receiving, an envelope E removed and dropped from the envelope rolling rollers 23 is disposed under the above two pairs of envelope rolling rollers 23*a*, 23*b*. The corners of the bottom of the container 50 are formed into curved surfaces 50*a* to alleviate a dropping impact on an envelope E dropped. In the vicinity of the top opening of the container 50, discharged envelope sensing means 33*a* is installed under the first envelope rolling rollers 23*a* and discharged envelope sensing means 33*b* is installed under the second envelope rolling rollers 23*b*.

Then, among actions taking place in the above-described structure, a paper P rolling up operation and an insertion operation to insert rolled paper P into an envelope by the insertion means 6 are described with reference to FIGS. 1 through 3B.

As is shown in FIG. 2, a sheet of paper P having an image formed thereon is discharged from the image forming apparatus 100 onto the paper collection tray 5, while it is guided by side fences 101. Once a number of sheets to be inserted into one envelope E have been discharged, a sheets feed pawl 25 of the paper collection tray 5, while moving from upstream to downstream in the paper discharge direction, pushes the rear edges of the sheets of paper P on the paper collection tray 5 to convey them to the insertion means 6. The sheets of paper P are guided by the side fences 101 and fed into the cover 7 from the opening 9 of the cover 7 of the insertion means 6 set in the paper receiving position. Then, the sheets hit against the lower part of the clamp plate 12 of the roll-up roller 8. Even if the sheets of paper P moved by the sheets feed pawl 25 protrude above the clamp plate 12, because the end fence 11 is attached to the top end of the clamp plate 12, the sheets of paper P hit against the end fence 11 and then are guided to the lower part of the clamp plate 12.

When the clamp plate 12 is actuated, it holds back the forward edges of the sheets of paper P between it and the peripheral surface of the roll-up roller 8. The rotary motor M1 is driven to turn the roll-up roller 8 and the sheets of paper P are pulled in the cover 7. Once the roll-up roller 8 has rotated in one turn, as shown in FIG. 3A, the holding back of the sheets of paper P by clamp plate 12 is released. Depending on the type, thickness, and the number of the sheets of paper P, the sheets of paper P spread in a circle by their resilience, contact the inner wall of the cover 7, remaining rolled in a cylindrical form, then are held by the inner wall. As is shown in FIG. 1 and FIG. 3B, one end part of the sheets of paper P rolled in a cylindrical form protrudes out of the discharge outlet 10 of the cover 7.

As is shown in FIG. 1, in the insertion means 6 set in the paper receiving position, when the sheets of paper P are held in a cylindrical form as described above and become ready to be inserted, the air nozzle 20 is actuated to blow air to the open end 18 of an envelope E and the air expands the envelope E and opens the open end 18.

When the insert motor M2 of the insertion means 6 is actuated, it moves the cover 7 and the roll-up roller 8 holding the sheets of paper P in a cylindrical form toward the envelope E and inserts the sheets of paper P along with the cover 7 and the roll-up roller 8 into the envelope E. When the insertion means 6 has inserted the sheets of paper P up to the farthest point in the envelope E, the pickup roller 22 and the envelope rolling rollers 23 start to operate and start to convey the envelope E downstream.

The envelope rolling rollers 23 nip and convey the envelope E downstream, whereas the insert motor M2 of the insertion means 6 moves the cover 7 and the roll-up roller 8 in a direction of withdrawal from the envelope E. Thereby, the sheets of paper P are removed from the cover 7 and the roll-up roller 8 within the envelope E, forwarded downstream along with the envelope E, pressed within the envelope E, and spread and folded to a size defined by the dimensions of the envelope E.

Given that, in this way, sheets of paper Pare rolled up in a cylindrical form and inserted into an envelope E by the insertion means 6 and the envelope E is nipped and conveyed by the envelope rolling rollers 23, the work of pressing and folding the sheets of paper P within the envelope E can be performed efficiently and surely in a simple process using the compact apparatus structure.

Among actions taking place in the above-described structure, the separating action of the removal means which removes an envelope E into which no sheet of paper P has been inserted will be described next with reference to FIG. 1, FIGS. 5A to 5C, and FIG. 6.

Figure 5A:
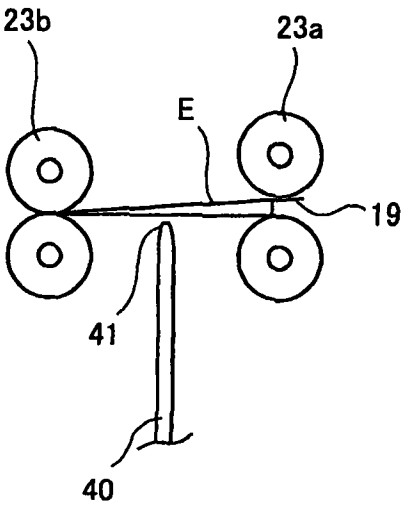
FIGS. 5A to 5C are sequential operation diagrams in a case where envelope rolling rollers in the first embodiment operate as removal means.

As previously described, if the position of an envelope E is incorrect, no sheet of paper P is inserted into the envelope E. Then, the envelope E containing no sheet of paper E is conveyed downstream by the pickup roller 22 shown in FIG. 1 and further conveyed by the first envelope rolling rollers 23*a*, while the envelope travel distance sensing means 31 shown in FIG. 1 detects the travel distance of the envelope E. When the longitudinal center of the envelope E shown in FIG. 6 (indicated by a center line C) has come to the fulcrum point 41 of the separator 40, as is shown in FIG. 5A, the envelope rolling rollers 23 stop their driving.

Figure 5B:
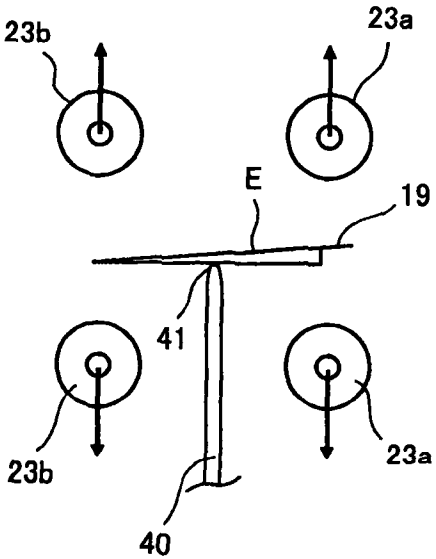

As is shown in FIG. 5B, of the first envelope rolling rollers 23*a* and the second envelope rolling rollers 23*b*, the upper rollers and the lower rollers move upward and downward respectively and go apart from each other. This brings the envelope E in a state where the longitudinal center of the envelope E is supported only by the fulcrum point 41 of the separator 40.

Figure 6:
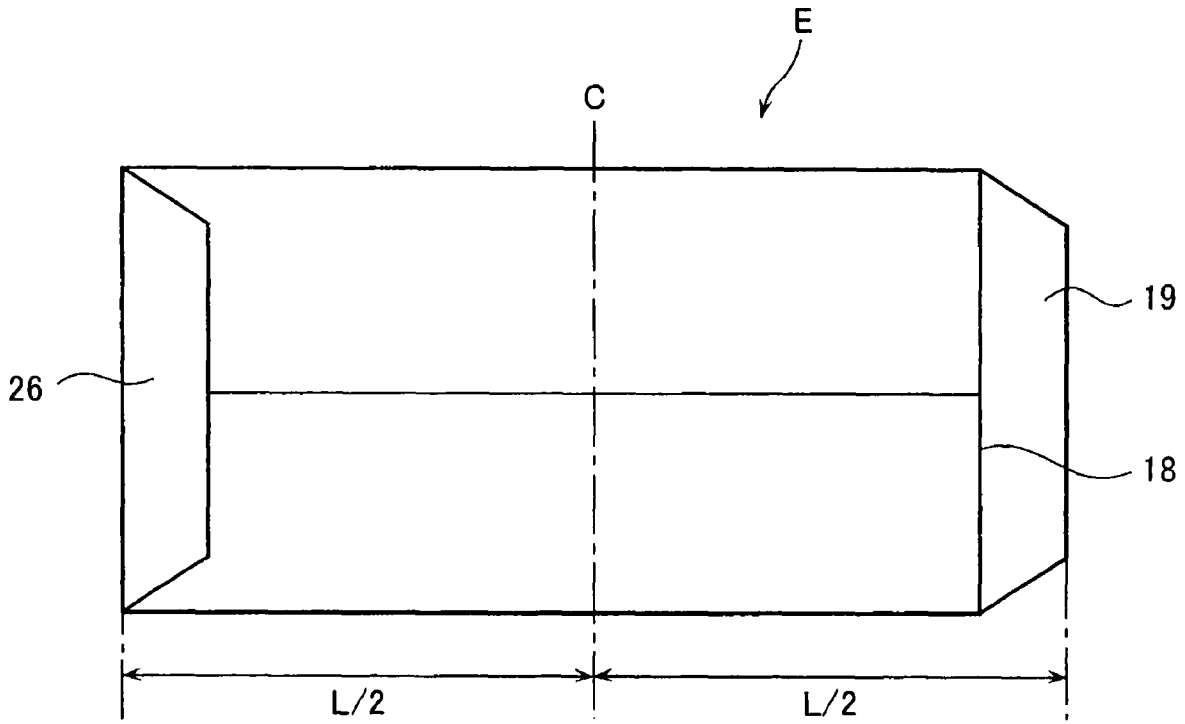
FIG. 6 is a diagram indicating a central position of an envelope which is removed in the first embodiment.

As is shown in FIG. 6, for an unused envelope E, its top end (upstream in the transport direction in this example), i.e., the open end 18 is open with the flap 19 being not closed and its bottom end 26 (downstream in the transport direction in this example) is pasted and closed. When comparing the weights of both sides with respect to the longitudinal center line C, the side of the top end with the flap 19 is lighter and the side of the closed bottom end 26 is heavier.

Figure 5C:
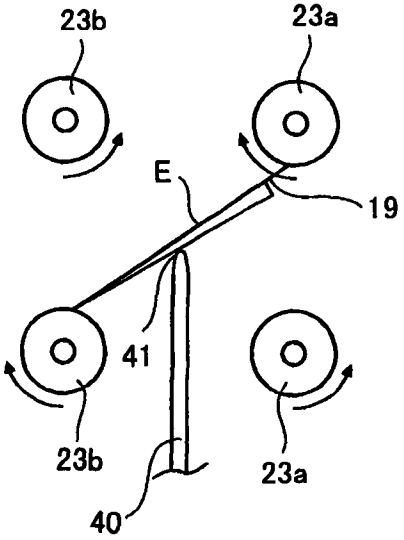

Consequently, as is shown in FIG. 5C, when the upper and lower rollers of the first envelope tolling rollers 23*a* and the second envelope rolling rollers 23*b* separate, the envelope. E supported only by the fulcrum point 41 of the separator 40 becomes unbalanced such that the bottom end which is relatively heavy descends and the top end with the flap 19 which is relatively light ascends.

Further, as is shown in FIG. 5C, when the upper and lower rollers of the first envelope rolling rollers 23*a* and the second envelope rolling rollers 23*b* separate, at the same time, the first envelope rolling rollers 23*a* start to rotate forward (as in normal roller operation) and the second envelope rolling rollers 23*b* start to rotate reversely (reverse to normal rotation). Thereby, the inclination of the envelope E with the flap 19 end ascending and the bottom end descending is intensified by the rotations of the first envelope rolling rollers 23*a* and the second envelope rolling rollers 23*b*. Eventually, the envelope E drops with the flap 19 up invariably. Dropping and keeping of the envelope E in the container 50 are detected by the discharged envelope sensing means 33*a*, 33*b*.

In this way, an envelope E dropped from the envelope rolling rollers 23 drops inside the container 50 with the flap 19 up invariably. This prevents the flap 19 from being broken or damaged due to its collision with the bottom of the container 50. Envelopes E thus collected in the container 50 can be set again and used in the envelope feed means 16, properly aligned in normal orientation.

The apparatus of the present embodiment is provided with a controller 200 for controlling and driving the above-described components as shown in FIG. 1 comprehensively. The function of the controller is to receive signals from the sensors and the like in the apparatus and operate the insertion means 6 and the removal means as described above, based on a program prestored in a storage means. Moreover, its function is to control the respective parts of the apparatus as will be described below.

In the following, descriptions will be provided for the actions to take place in the above described structure, mainly referring to a timing chart of FIG. 7, with the focus on the actions to take place in a case where no sheet of paper P is inserted into an envelope E and the envelope E is separated and removed. Symbols t1 to t5 referred to in the following description indicate timing in time sequence with regard to FIG. 7 and numbers in parentheses indicate item numbers relevant to the actions and the like.

Timing t1: The elevator of the envelope feed means 16 operates to set an envelope E in a prescribed insertion position. When the envelope sensing means 17 detects that an envelope E is placed in the normal insertion position and outputs a sensing signal (1), the air nozzle 20 is actuated to blow air into the envelope E and the air expands the envelope E (2).

Timing t2: During the actuation of the air nozzle 20 for a predetermined given time T1, if the correct envelope position sensing means 21 does not output a sensing signal (when sensing is OFF), denoted as a dotted line in FIG. 7, the pickup roller 22 conveys an empty envelope E downstream (4) and the envelope rolling rollers 23 also start rotation and start to convey the envelope E downstream (6).

Figure 7:
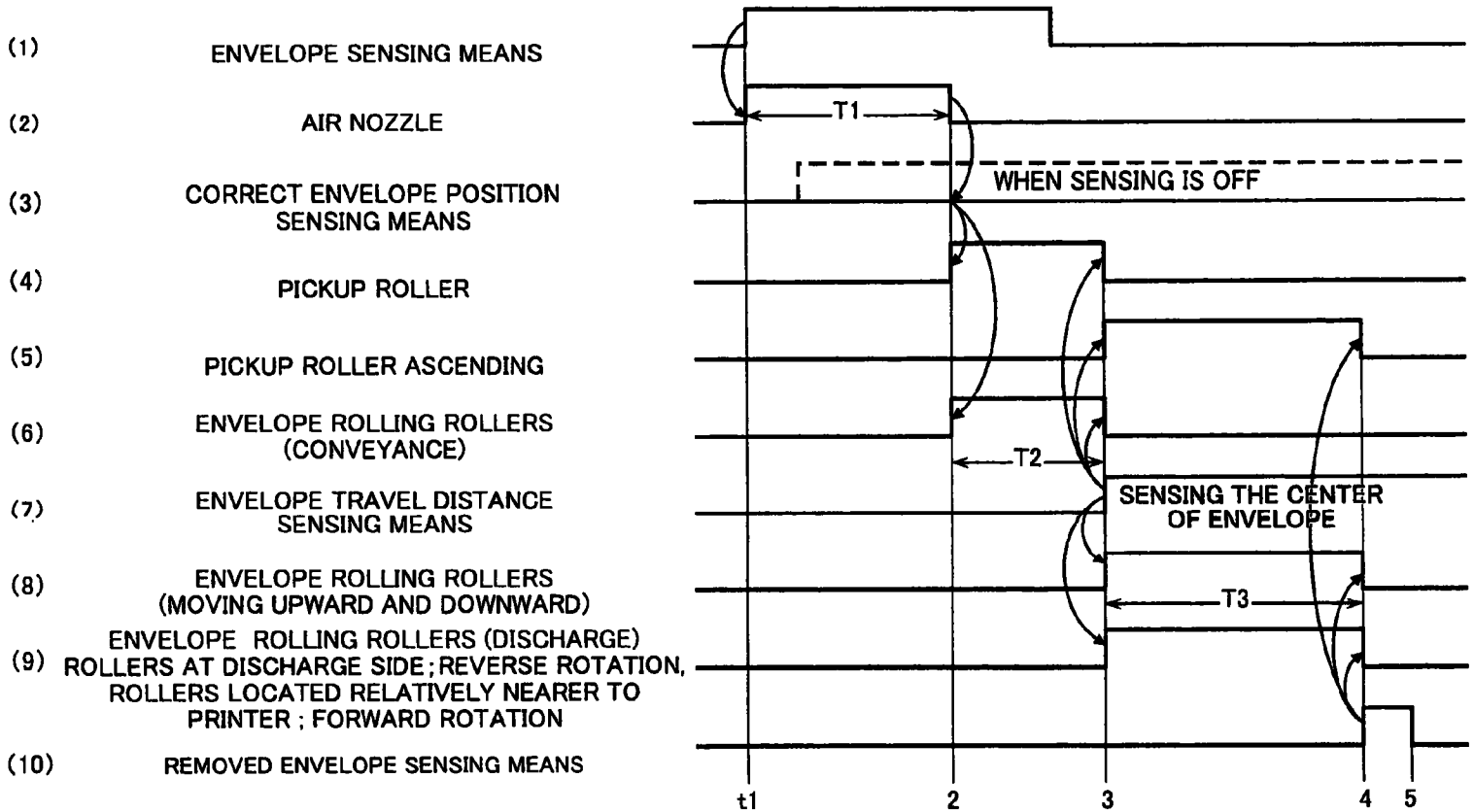
FIG. 7 is a timing diagram with regard to the operations of respective parts representing actions in the first embodiment.

Although not shown in FIG. 7, in a case where the correct envelope position sensing means 21 outputs a sensing signal (when sensing is ON), as supposedly implied by the dotted line in FIG. 7, during the actuation of the air nozzle 20 for the given time T1, this situation means that the envelope E is placed in the normal orientation and the open end 18 has been opened by air from the air nozzle 20 and, therefore, the insertion means 6 operates to insert the rolled sheets of paper P into the envelope E, as previously described. Then, the pickup roller 22 conveys the envelope E downstream and the envelope rolling rollers 23 further convey the envelope E, while pressing the envelope E. Thereby, the sheets of paper P are pressed and folded within the envelope E and then the envelope E is conveyed to the filled envelope tray 24.

Timing t3: Upon the elapse of a time T2 corresponding to the time during which the envelope rolling rollers 23 convey the envelope E by L/2 which is a half the length L of the envelope E, the envelope travel distance sensing means 31 detects the center of the envelope E conveyed by the envelope rolling rollers 23 (7). The sensing signal issued by the envelope travel distance sensing means 31 causes the pickup roller 22 to stop (4) and to move upward (5) (see FIG. 5B) and causes the rotation of the envelope rolling rollers 23 to stop (6) (see FIG. 5A). At the same time, this signal causes the first envelope rolling rollers 23*a* and the second envelope rolling rollers 23*b* to move apart from each other (8) (see FIG. 5B) and causes the first envelope rolling rollers 23*a* located relatively nearer to the printer to rotate forward and the second envelope rolling rollers 23*b* located at the discharge side to rotate reversely (9) (see FIG. 5C).

Timing t4: Upon the elapse of at least a given time T3 during which the state continues where the upper and lower rollers of the first envelope rolling rollers 23*a* and the second envelope rolling rollers 23*b* separate (8) and the first envelope rolling rollers 23*a* rotate forward while the second envelope rolling rollers 23*b* rotate reversely (9), the envelope E mounted on the fulcrum point 41 of the separator 40 becomes unbalanced and drops in the container 50.

Timing t5: When the discharged envelope sensing means 33*a* or 33*b* disposed at the entrance of the container 50 detects the envelope E, its sensing signal triggers the stop of the rotations of the first envelope rolling rollers 23*a* and the second envelope rolling rollers 23*b* (9). Then, the separate upper and lower rollers of the first envelope rolling rollers 23*a* and the second envelope rolling rollers 23*b* are reverted to contact each other (8) and the pickup roller 22 is moved down to return to the position where it can convey an envelope downstream (5).

As described hereinbefore, according to the embodiment of the present invention, in the envelope filling apparatus 1 provided with the functions of opening the open end 18 of an envelope E placed in a prescribed orientation by air and inserting a sheet of paper P into the envelope E, if the orientation of an envelope E is incorrect, this envelope is separated from envelopes E containing sheets of paper P normally inserted therein. Such envelopes without contents can be removed from the normal insertion and transport route and carried to and collected in another place. To separate such empty envelopes E, a method is used in which the envelope falls by its own weight from the normal route with the flap 19 up which is liable to be damaged by impact. Therefore, this prevents the flap 19 of the separated envelope E from being damaged and the envelope E is stored in the container 50 with the flap 19 up. These envelopes can be served for reuse, when they are set with their front and back being aligned properly in the envelope feed means 16.

What is claimed is:

1. An envelope filling apparatus for inserting a sheet of paper into an envelope including a predetermined length and an open end having a flap, comprising:

an envelope feed device for feeding the envelope oriented in a fixed orientation to a prescribed position;

an air nozzle for blowing air into the envelope fed by the envelope feed device from the open end of the envelope to open the open end;

a sensing device installed above the envelope fed by the envelope feed device for detecting that the open end of the envelope is opened; and an insertion device for rolling the sheet of paper around an axis line thereof and inserting the sheet of paper into the envelope from the open end.

2. The envelope filling apparatus according to claim 1, wherein the insertion device comprises a cylindrical cover for keeping a state of the sheet of paper to be rolled, a roll-up roller coaxially disposed inside the cover for rolling up the sheet of paper thereinside, and a motion device for reciprocally sliding the cover and the roll-up roller in a direction along the axis line thereof.

3. The envelope filling apparatus according to claim 2, wherein the air nozzle is configured to blow air toward a position corresponding to the flap of the envelope placed in the prescribed position by the envelope feed device.

4. The envelope filling apparatus according to claim 3, further comprising a removal device for removing the envelope from a transport route, if the sensing device does not detect that the open end of the envelope is opened after the air nozzle is actuated and the insertion device is not actuated, wherein the insertion device inserts the sheet of paper into the envelope from the open end, if the sensing device detects that the open end of the envelope is opened after the air nozzle is actuated.

5. The envelope filling apparatus according to claim 4, further comprising: two pairs of envelope rolling rollers with a space, which is shorter than the predetermined length of the envelope, away from each other, said two pairs of envelope rolling rollers being loaded in a stage following the envelope fed by the envelope feed device, wherein the envelope rolling rollers convey the envelope containing the sheet of paper inserted therein to a prescribed position for discharge thereof, and the envelope rolling rollers guide the envelope containing no sheet of paper to a prescribed position for discharge thereof, and wherein the removal device includes a separator having a fulcrum point in a center of an envelope transport path between the two pairs of envelope rolling rollers and a mechanism operating such that when a longitudinal center of the envelope containing no sheet of paper is conveyed by the envelope rolling rollers to the fulcrum point of the separator, the envelope rolling rollers in each of the two pairs are separated from each other to release a nipping of the envelope, and the envelope falls for removal by rotating around the fulcrum point by an own weight thereof.

6. The envelope filling apparatus according to claim 5, wherein the removal device rotates the envelope rolling rollers in a rear position reversely to normal rotation for conveying an envelope downstream, when the envelope falls.

7. The envelope filling apparatus according to claim 2, further comprising a retaining device for retaining the flap of the envelope placed in the prescribed position by the envelope feed device.

8. The envelope filling apparatus according to claim 7, further comprising a removal device for removing the envelope from a transport route, if the sensing device does not detect that the open end of the envelope is opened after the air nozzle is actuated and the insertion device is not actuated, wherein the insertion device inserts the sheet of paper into the envelope from the open end, if the sensing device detects that the open end of the envelope is opened after the air nozzle is actuated.

9. The envelope filling apparatus according to claim 1, wherein the insertion device comprises a cylindrical cover for rolling the sheet of paper, the cylindrical cover being arranged perpendicular to a sheet insertion direction, and a motion device for reciprocally sliding the cover in a longitudinal direction thereof.

10. The envelope filling apparatus according to claim 9, further comprising a pair of envelope rolling rollers disposed downstream of the envelope feed device for folding the envelope with the sheet of paper inserted therein.

11. The envelope filling apparatus according to claim 10, wherein the insertion device further comprises a roll-up roller coaxially disposed inside the cover for rolling up the sheet of paper thereinside, the motion device reciprocally sliding the cover and the roll-up roller along the longitudinal direction.

12. The envelope filling apparatus according to claim 11, wherein the insertion device further comprises a slit opening, an end fence disposed above the slit opening with a prescribed angle relative to the sheet to be inserted for guiding the sheet in the slit opening, and a clamp plate slidably attached on the roll-up roller for holding and releasing a leading edge of the sheet onto a peripheral surface of the roll-up roller.

13. An envelope filling apparatus for inserting a sheet of paper into an envelope including a predetermined length and an open end having a flap, comprising:

an envelope feed device for feeding the envelope oriented in a fixed orientation to a prescribed position;

an air nozzle for blowing air into the envelope fed by the envelope feed device from the open end of the envelope to open the open end;

a sensing device installed above the envelope fed by the envelope feed device for detecting that the open end of the envelope is opened;

an insertion device for inserting the sheet of paper into the envelope from the open end, if the sensing device detects that the open end of the envelope is opened after the air nozzle is actuated;

a removal device for removing the envelope from a transport route, if the sensing device does not detect that the open end of the envelope is opened after the air nozzle is actuated and the insertion device is not actuated, and two pairs of envelope rolling rollers with a space, which is shorter than the predetermined length of the envelope, away from each other, said two pairs of envelope rolling rollers being loaded in a stage following the position of the envelope fed by the envelope feed device, wherein the air nozzle is configured to blow air toward a position corresponding to the flap of the envelope placed in the prescribed position by the envelope feed device, wherein the envelope rolling rollers convey the envelope containing the sheet of paper inserted therein to a prescribed position for discharge thereof, and the envelope rolling rollers guide the envelope containing no sheet of paper to a prescribed position for discharge thereof, and wherein the removal device includes a separator having a fulcrum point in a center of an envelope transport path between the two pairs of envelope rolling rollers and a mechanism adapted such that, after the envelope containing no sheet of paper is conveyed by the envelope rolling rollers until a longitudinal center of the envelope comes to the fulcrum point of the separator, the envelope rolling rollers in each of the two pairs are separated from each other to release a nipping of the envelope, and the envelope is let fall in an underneath position for removal by rotating around the fulcrum point by an own weight thereof.

* * * * *